US007325480B2

(12) United States Patent
Grühbaum et al.

(10) Patent No.: US 7,325,480 B2
(45) Date of Patent: Feb. 5, 2008

(54) APPARATUS FOR TREATING AND PREPARING FOOD BY GAS-FIRED HEATING AND A HEAT EXCHANGE DEVICE FOR SUCH AN APPARATUS

(75) Inventors: Klaus Grühbaum, Landsberied (DE); Johannes Hillmann, Neu-Ulm (DE)

(73) Assignee: eloma GmbH Grosskuchentechnik, Maisach (DE)

( * ) Notice: Subject to any disclaimer, the term of this patent is extended or adjusted under 35 U.S.C. 154(b) by 396 days.

(21) Appl. No.: 10/375,382

(22) Filed: Feb. 27, 2003

(65) Prior Publication Data

US 2003/0164096 A1 Sep. 4, 2003

(30) Foreign Application Priority Data

Mar. 1, 2002 (EP) ..... 02004761

(51) Int. Cl.
*A23L 1/00* (2006.01)

(52) U.S. Cl. ..... 99/330; 99/467; 99/476

(58) Field of Classification Search ..... 99/326–334, 99/337–340, 342, 352–355, 403–417, 467–476, 99/516, 483; 126/21 A, 20, 19 R, 21 R, 126/369, 99 R; 432/176, 199; 219/401, 219/400; 426/523, 521, 509–511
See application file for complete search history.

(56) References Cited

U.S. PATENT DOCUMENTS 3,889,099 A * 6/1975 Nuss ..... 219/393
4,110,916 A * 9/1978 Bemrose ..... 34/197
5,016,605 A * 5/1991 LaForet et al. ..... 126/20
5,215,000 A * 6/1993 Desage et al. ..... 99/331
5,517,980 A * 5/1996 Cappello et al. ..... 126/20
5,556,566 A * 9/1996 Cappello et al. ..... 219/683
5,636,622 A * 6/1997 Urcelay Amondarain et al. ..... 126/20
6,267,045 B1 7/2001 Wiedemann et al.
6,311,685 B1 * 11/2001 Bassoli et al. ..... 126/21 A
6,938,459 B2 * 9/2005 Gruhbaum et al. ..... 73/24.04

FOREIGN PATENT DOCUMENTS

DE 41 25 696 C1 2/1993
DE 298 00 523 U1 6/1999
EP 92111870.9 2/1993
EP 00830211.9 6/2001
EP 01100573.3 7/2001
EP 01116786.3 1/2002
JP 2003262339 A * 9/2003

* cited by examiner

*Primary Examiner*—Timothy F. Simone
(74) *Attorney, Agent, or Firm*—Jansson Shupe & Munger Ltd.

(57) ABSTRACT

The present invention refers to an apparatus for treating and preparing food having a cooking chamber in which the food is treated and cooked. The apparatus further includes a motor-driven ventilation fan which serves to circulate the cooking chamber atmosphere, and a gas burner which serves for combusting the gas-air mixture. The cooking chamber is heated by use of a heat exchange device which includes a heat exchange pipe assembly. The heat exchange device surrounds the ventilation fan. The heat exchange pipe assembly is characterized in that at least two pipe strands are provided which extend substantially around the ventilation wheel in a continuous bordering or loop of the ventilation wheel. The subject matter of the present invention is also a heat exchange device for an apparatus of this type.

11 Claims, 4 Drawing Sheets

APPARATUS FOR TREATING AND PREPARING FOOD BY GAS-FIRED HEATING AND A HEAT EXCHANGE DEVICE FOR SUCH AN APPARATUS

FIELD OF THE INVENTION

The present invention refers to an apparatus for treating and preparing food, wherein the apparatus comprises a cooking chamber in which the food is treated and cooked, a motor-driven ventilation fan which provides circulation of the cooking chamber atmosphere, a burner which provides for the combustion of a gas-air mixture, and a heat exchange device which includes a heat exchange pipe assembly that surrounds the ventilation fan.

The present invention further refers to a heat exchange device for an apparatus of this type.

BACKGROUND OF THE INVENTION

A heat exchange means for a cooking apparatus is, for instance, known from DE 197 08 231 A1. The heat exchange means of this prior art comprises a substantially horizontally arranged combustion chamber which communicates with a heat exchange pipe into which the combusted gas-air mixture is fed. The heat exchange pipe extends along the four sides of the cooking chamber in the direction away from the combustion chamber and reverses at the end of the fourth side by means of a free cantilevered fold in order to cover the same path in parallel to the pipe strand leaving the combustion chamber. Moreover, the single heat exchange pipe extends along the combustion chamber until below the free cantilevered fold from where the exhaust gas is discharged.

A particular disadvantage of this prior art results from the fact that a very long path in a heat exchange pipe is required of the heated gas, whereby only a relatively weak heat exchange is realized. Moreover, from the fluidic point of view, the course of the heat exchange pipe is extremely unfavorable due to the reversal of the flow direction required by this prior art.

SUMMARY OF THE INVENTION

The object of the present invention is therefore to provide an apparatus for treating and preparing food in a cooking chamber, which is heated by gas-firing, in which the heat exchange device provides a significantly increased heat transfer, which requires significantly lower heating power, and which leads to significantly lower exhaust gas loss.

This object is achieved by an apparatus comprised of a cooking chamber, a motor-driven ventilation fan, a gas burner, and a heat exchange device. The heat exchange device includes a heat exchange pipe assembly comprising at least two pipe strands that substantially extend around the ventilation fan in a loop.

By the fact that the heat exchange pipe assembly comprises at least two pipe strands, which extend continuously in a bordering of the ventilation fan, the assembly achieves, on the one hand, an optimal flow path for the heated gas and, on the other hand, a significantly improved heat exchange function.

The heat exchange function is preferably increased by an embodiment of the present invention where three pipe strands are provided, i.e. the heated gas flow is divided into three portions.

Most preferred is where the three pipe strands are arranged triangularly in the longitudinal pipe direction. This has the particular advantage that the heat exchange pipes additionally serve as extremely efficient evaporization means, when, as intended with this invention, water is directly injected into the ventilation fan via a supply line and is directed outward by the fan. Due to the radial discharge of the injected water, the water not yet evaporated at the outer circumference of the ventilation fan is thrown against the pipe strands to finally evaporate there. This has the added benefit of avoiding water not yet evaporated being thrown against the inner wall of the apparatus.

Also most preferred, the pipe strands extend substantially along all four sides of the cooking chamber, but not along the burner. As a result, a compact structure of the cooking apparatus is realized on the one hand while, on the other hand, the potential diameter of the combustion chamber can be increased thereby leading to a better and more complete combustion of the gas-air mixture.

During the flow of a gas in a pipe, a flow profile is generated in which, due to the friction of the gas at the inner wall of the tube, the lowest flow speed is present along the outside while, in the center, the highest flow speed prevails. This leads to poor heat exchange since the quickly flowing central layer of the gas does not participate in the heat exchange function at all or participates only to a minor extent. In an especially advantageous embodiment, at least one pipe strand, preferably all pipe strands, have at least one flow deflector. By means of the flow deflector, the flowing gas can be transformed from a laminar flow into a turbulent flow so that portions of the center of the flow reach the outside. thereby significantly increasing the efficiency of the heat exchange process. Moreover, this makes possible that the length of the respective pipe strand can be significantly shortened compared to the prior art.

In a most preferred embodiment of this invention, two flow deflectors are arranged in each pipe strand, said flow deflectors being arranged at a spacing to each other so that a multiple transformation of the flow from a laminar flow into a turbulent flow is realized to increase the efficiency of the heat exchange.

An especially efficient combustion of the gas-air mixture is achieved by the fact that the combustion chamber is arranged substantially vertical. Especially advantageous is that the flame in the combustion chamber is directed downwards. This leads to the greatest heat being introduced into the bottom of the cooking chamber, which results in a more regular heat distribution in the cooking chamber. Furthermore, a great advantage from this is that a path for the exhaust gas within the apparatus is possible which can be kept as short as possible outside the cooking chamber.

The subject matter of the present invention is also a heat exchange device for an apparatus for treating and preparing food, said apparatus comprising a heat exchange pipe assembly. The heat exchange pipe assembly comprises at least two pipe strands which extend continuously around the ventilation fan substantially bordering the ventilation fan.

Further details, features and advantages of the present invention can be derived from the following description with reference to the drawings.

DETAILED DESCRIPTION OF PREFERRED EMBODIMENTS

Figure 1:
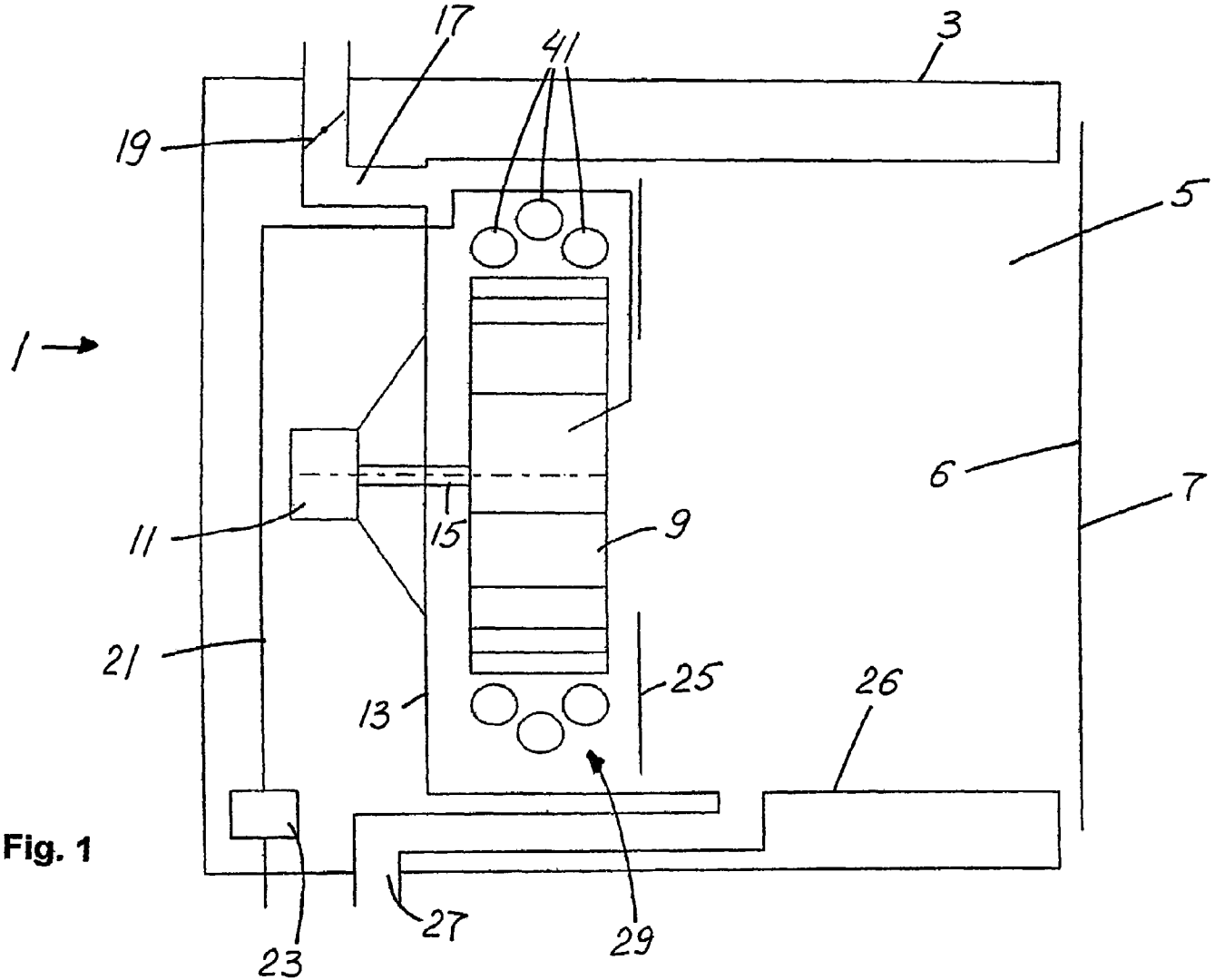
FIG. 1 schematically shows in a lateral cross sectional view the structure of an apparatus according to the invention for treating and preparing food in the form of a combination steamer.

FIG. 1 schematically shows the side view of the structure of an apparatus 1 according to the invention in the form of a combination steamer for treating and preparing food. The apparatus 1 includes a housing 3. A cooking chamber 5 is provided within the housing 3, whereby the food to be treated or prepared is introduced into said cooking chamber. The cooking chamber 5 can be opened and closed on its front side 6 in the usual manner by a door 7.

Figure 2:
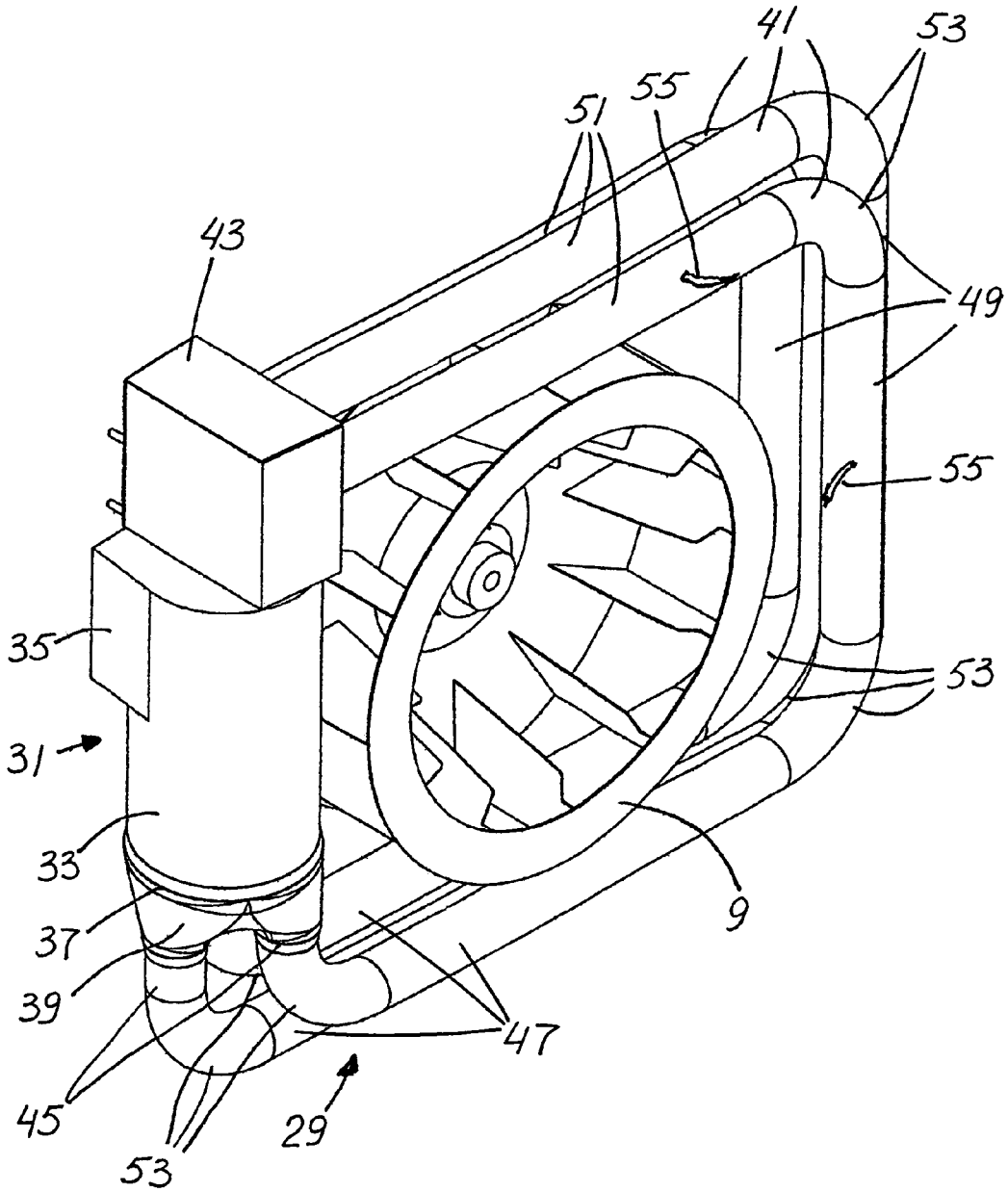
FIG. 2 shows in a perspective view the heat exchange device according to the invention, which extends around the radial ventilation fan.

Behind a substantially vertically arranged spoiler 25, a radial ventilation fan 9 is positioned whose structure can be clearly understood from FIG. 2. The radial fan 9 is driven by an asynchronous motor 11. The asynchronous motor 11 positioned behind a rear wall 13 of the cooking chamber 5, and includes a drive shaft 15 which is connected to the radial ventilation fan 9 as the drive thereof.

To adjust the moisture in the cooking chamber 5, an inlet air channel 17 is provided in which a controllable flap 19 is inserted. To generate vapor in the cooking chamber 5, a water inlet 21 also provided, which includes a controllable supply inlet valve 23.

As may be seen from FIG. 1, the water inlet 21 ends in the central portion of the ventilation fan 9, i.e. the water to be vaporized is injected into the central portion of the ventilation fan 9, whereby a portion of the water evaporates. The spoiler 25 provided between the radial fan 9 and the cooking chamber 5 serves to distribute the air in the cooking chamber.

In the lower portion 26 of the apparatus 1, an outlet 27 is further provided through which liquid, particularly vapors, may be discharged and which also serves for pressure compensation.

A heat exchange device 29 extends around the radial ventilation fan 9, said heat exchange device being described hereinafter with reference to FIG. 2.

As may be seen from FIG. 2, the heat exchange device 29 extends around the radial ventilation fan 9 and substantially follows the inner contour of the apparatus 1. The heat exchange device 29 is supplied by a gas burner 31 which includes a combustion chamber 33. The combustion chamber 33 is, as may be seen from FIG. 2, arranged vertically. It has a gas inlet 35 through which a gas-air mixture is introduced into the combustion chamber 33.

A heat exchanger terminal 39 is provided on the lower outlet 37 of the combustion chamber 33, said heat exchanger terminal communicating with three pipe strands 41, which form the heat exchange device 29.

As may be seen from FIG. 2, the pipe strands 41 extend in a bordering or loop around the ventilation fan 9 and end in an exhaust gas manifold and discharge means 43.

Each pipe 41 has a substantially short first vertical tube section 45, a first substantially horizontal tube section 47, a second substantially vertical tube section 49 and a second substantially horizontal tube section 51. The tube sections 45 to 51 are joined via quadrant pipe sections 53.

Figure 3:
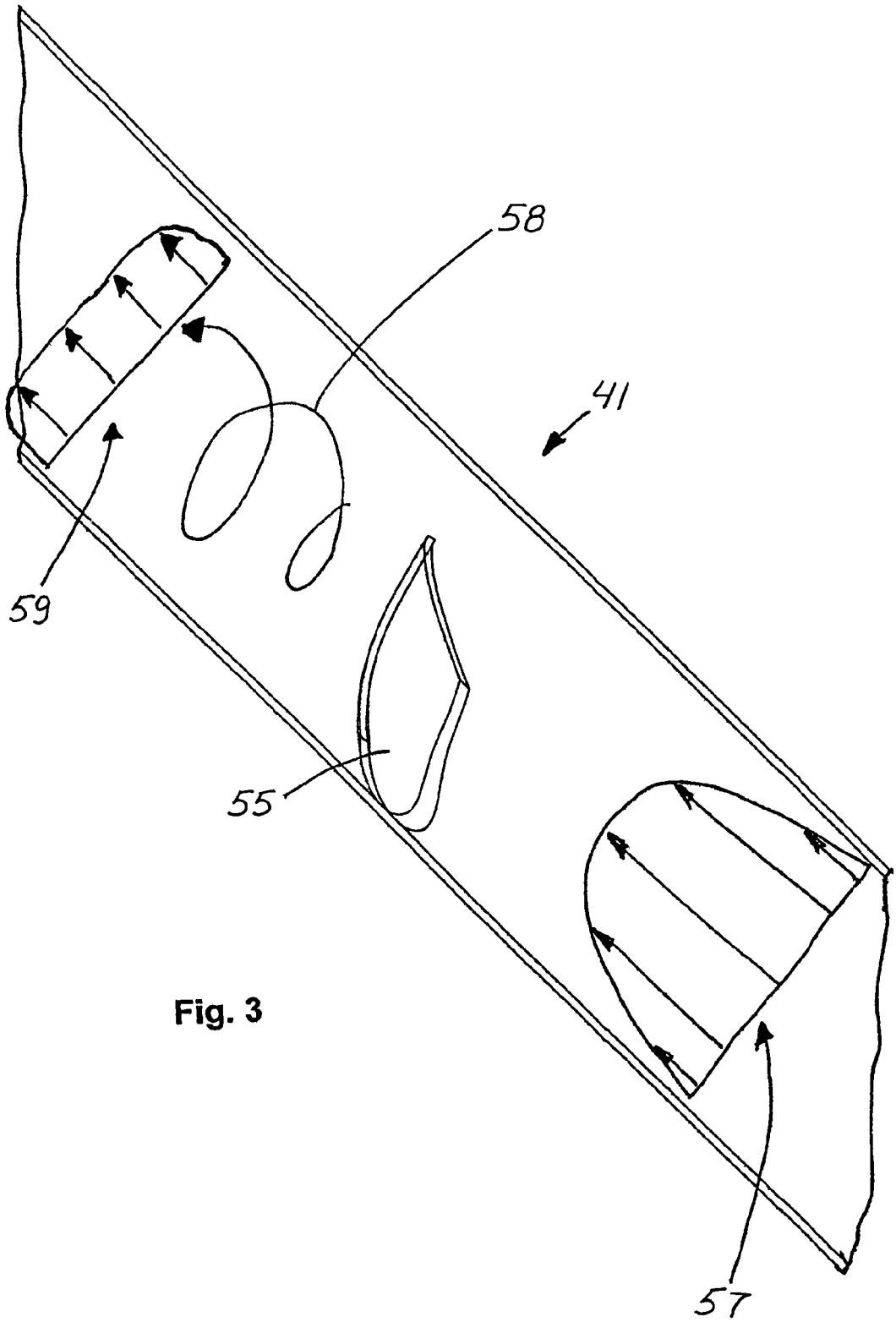
FIG. 3 shows a schematic view of a heat exchange pipe with a flow deflector.

As may further be seen from FIG. 2, a flow deflector 55 is inserted in the second vertical pipe section 49 and in the second horizontal pipe section 51, said flow deflector being shown in more detail in FIG. 3.

As may be seen from FIG. 3, the heat exchange gas moves in the pipe strand 41 in front of the flow deflector 55 substantially according to a flow profile 57. The laminar flow 57 is swirled by means of the flow deflector 55. Then, in the ideal case, a uniform flow is generated as indicated by the turbulent flow profile 59.

FIG. 2 schematically shows only two flow deflectors 55 in the front pipe strand 41. It is highly preferred that at least two flow deflectors 55 be present in each of the pipe strands 41. A flow deflector 55 may also be inserted in the first horizontal pipe section 47 and/or an additional flow deflector 55 may be positioned within the second horizontal pipe section 51.

A special advantage of the present invention also derived from the embodiment of the flow deflector 55 schematically shown in FIG. 2 is that the dynamic pressure within the pipe strands 41, and thus the power of a circulation fan (not shown) to produce it, can be minimized. Thus, the circulation fan may be kept small which enhances the compact structure of the entire apparatus and which reduces the energy consumption of the circulation fan.

FIG. 1 more clearly shows the triangular arrangement of the pipe strands 41. The water thrown out by the ventilation fan 9 in the radial direction impinges on the pipe strands 41, wherein, as may be seen from FIG. 1, these pipe strands completely cover the radial discharge space of the fan. Thus, the water thrown out impinges onto the pipe strands 41 and not onto the inner wall of the cooking apparatus, whereby an optimal evaporation of the water introduced can be obtained.

Figure 4:
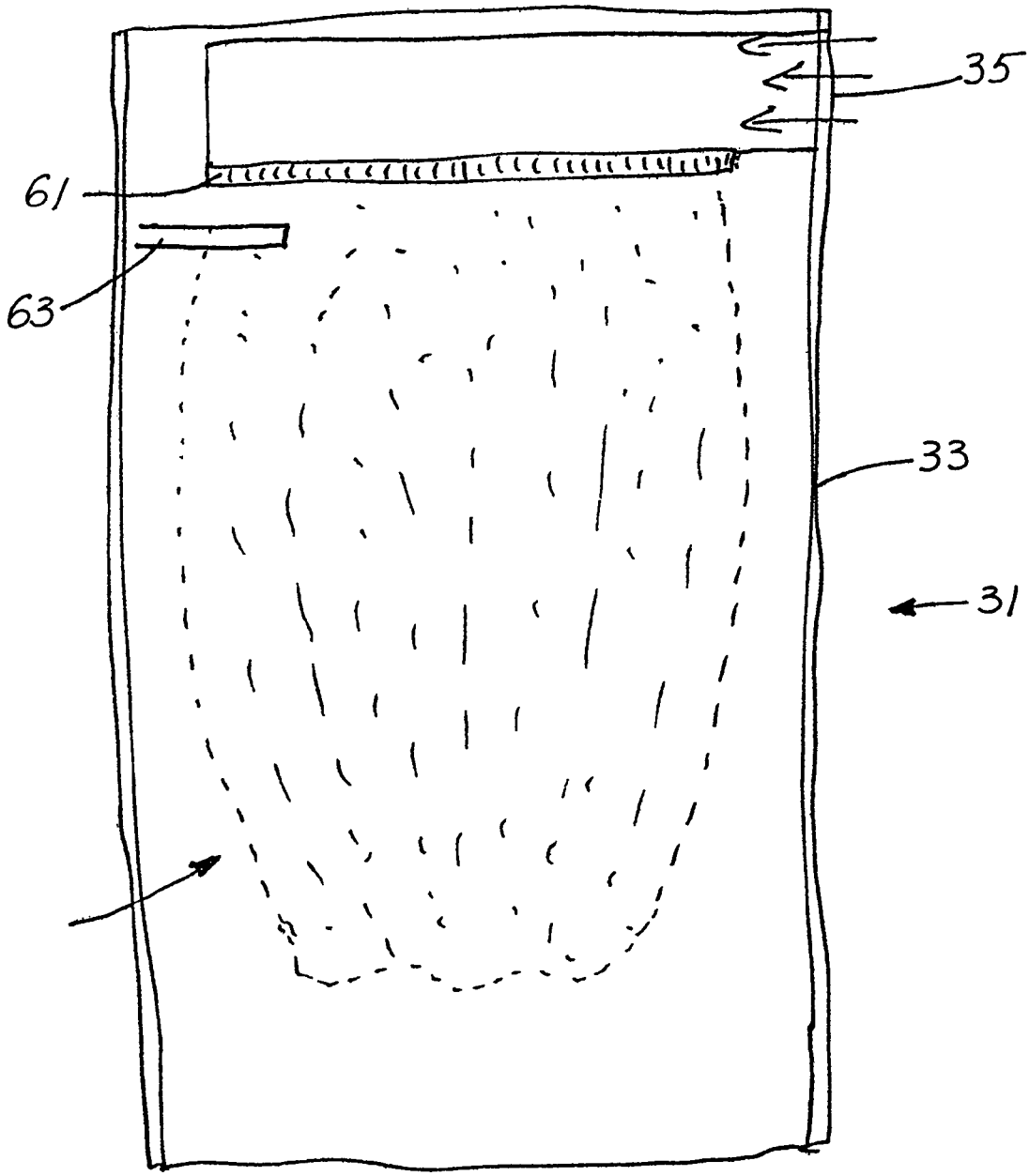
FIG. 4 shows a schematic view of a combustion chamber with a flame.

FIG. 4 schematically shows the gas burner 31. A substantially circular grid 61 is arranged in the combustion chamber 33, and the gas-air mixture, which enters via the gas inlet 35 into the combustion chamber, flows through the grid 61. Below the grid, an ignition means 63 is arranged which ignites the gas-air mixture, and a combustion cone 65, drawn in dotted lines, is formed by the resulting flame which extends vertically downward in the combustion chamber 33. The arrangement of the combustion cone 65 has the advantage of a substantially complete combustion of the gas-air mixture, wherein, due to the grid structure of the grid 61, the flame cone 65 is composed of a plurality of single flames.

The present invention provides an apparatus for treating and preparing food with a very advantageously designed gas-firing mechanism and an advantageously designed heat exchange device.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. An apparatus for treating and preparing food, the apparatus comprising:

a cooking chamber having a lower portion and four sides including a front side and a rear wall extending vertically upward from the lower portion, the cooking chamber defining an atmosphere wherein the food is treated and cooked;

a motor-driven ventilation fan configured to circulate the atmosphere in the cooking chamber;

a gas burner configured to burn a gas-air mixture, the gas burner having a combustion chamber oriented substantially vertical with respect to the front side and rear wall, wherein the combustion chamber forms a flame directed substantially downward therein when the gas burner is burning the gas-air mixture, and;

a heat exchange device in gaseous flow communication with respect to the gas burner, the heat exchange device having a heat exchanger terminal abutting the combustion chamber and being in direct gaseous communication with the combustion chamber and a heat exchange pipe assembly that has at least two pipe strands, each of the pipe strands extending substantially outward from the heat exchanger terminal, wherein the heat exchange pipe assembly extends substantially around the ventilation fan no more than once in a continuous loop.

2. The apparatus of claim 1 wherein the heat exchange pipe assembly has three pipe strands extending substantially outward from the heat exchanger terminal.

3. The apparatus of claim 2 wherein the three pipe strands are arranged triangularly in the longitudinal direction of the pipe strands.

4. The apparatus of claim 1 wherein the pipe strands extend substantially along all four sides of the cooking chamber but not along the burner.

5. The apparatus of claim 1 wherein at least one flow deflector is mounted within at least one pipe strand.

6. The apparatus of claim 5 wherein two flow deflectors are mounted within each pipe strand separated by a distance.

7. The apparatus of claim 1 wherein the combustion chamber includes a grid such that the gas-air mixture flows through the grid before the mixture is ignited whereby the flame is a combustion cone comprised of a plurality of individual flames.

8. The apparatus of claim 1 wherein the pipe strands terminate at an exhaust gas manifold positioned above the combustion chamber and the heat exchanger terminal is positioned beneath the combustion chamber.

9. A heat exchange device for an apparatus of the type for treating and preparing food and having a cooking chamber with a lower portion, a front side and rear wall extending vertically upward from the lower portion, and a ventilation fan, the device comprising a heat exchanger terminal in direct gaseous communication with a gas burner configured to burn a gas-air mixture and having a combustion chamber oriented substantially vertical with respect to the front side and rear wall, the combustion chamber forming a flame directed substantially downward therein when the gas burner is burning the gas-air mixture, the heat exchanger terminal abutting the combustion chamber, and a heat exchange pipe assembly having at least two pipe strands, each of the pipe strands extending substantially outward from the heat exchanger terminal, wherein the heat exchange pipe assembly extends substantially around the ventilation fan no more than once in a continuous loop.

10. The device of claim 9 wherein the heat exchange pipe assembly has three pipe strands, the pipe strands extending parallel to each other and extending continuously around the ventilation wheel but not along the burner.

11. The device of claim 9 wherein at least one flow deflector is mounted within at least one pipe strand.

* * * * *